US007283132B2

(12) United States Patent
Ishibashi et al.

(10) Patent No.: US 7,283,132 B2
(45) Date of Patent: Oct. 16, 2007

(54) DISPLAY PANEL DRIVER

(75) Inventors: Osamu Ishibashi, Tokyo (JP); Hideki Asada, Tokyo (JP); Hiroshi Haga, Tokyo (JP)

(73) Assignee: NEC Corporation, Tokyo (JP)

( * ) Notice: Subject to any disclaimer, the term of this patent is extended or adjusted under 35 U.S.C. 154(b) by 710 days.

(21) Appl. No.: 10/836,276

(22) Filed: May 3, 2004

(65) Prior Publication Data

US 2004/0227747 A1 Nov. 18, 2004

(30) Foreign Application Priority Data

May 14, 2003 (JP) ..... 2003-135631

(51) Int. Cl.
*G09G 5/00* (2006.01)
*G09G 3/36* (2006.01)

(52) U.S. Cl. ..... 345/212; 345/87; 345/204; 345/211; 345/212

(58) Field of Classification Search ..... 345/87, 345/98, 99, 100, 204, 211, 212
See application file for complete search history.

(56) References Cited

U.S. PATENT DOCUMENTS 6,480,180 B1 * 11/2002 Moon ..... 345/98
6,606,088 B1 * 8/2003 Yang et al. ..... 345/211
6,678,834 B1 * 1/2004 Aihara et al. ..... 713/501
6,992,508 B2 * 1/2006 Chow ..... 326/86
7,193,623 B2 * 3/2007 Moon ..... 345/205
2004/0189628 A1 * 9/2004 Chun et al. ..... 345/211

FOREIGN PATENT DOCUMENTS

JP 2000-152130 5/2000

* cited by examiner

*Primary Examiner*—Richard Hjerpe
*Assistant Examiner*—My-Chau T. Tran
(74) *Attorney, Agent, or Firm*—McGinn IP Law Group, PLLC

(57) ABSTRACT

The relationship $L1 \leqq V(F1 \times \in 1^{1/2} \times 100)$ is satisfied where a transmission path length between the interface 1 and the timing controller is L1, a propagating speed of electromagnetic waves in a vacuum is V, a frequency of a signal transmitted between the interface and the timing controller is F1, and a comparative dielectric constant of a transmission path medium between the interface and the timing controller is $\in 1$. The relationship $L2 \leqq V(F2 \times \in 2^{1/2} \times 100)$ is satisfied where a transmission path length between the timing controller and the signal driving portion is L2, a propagating speed of electromagnetic waves in a vacuum is V, a frequency of a signal transmitted between the timing controller and the signal line driving portion is F2, and a comparative dielectric constant of a transmission path medium between the timing controller and the signal line driving portion is $\in 2$. Thus, the occurrence of EMI noise can be suppressed, and the implementation cost of a display apparatus can be reduced.

29 Claims, 10 Drawing Sheets

DISPLAY PANEL DRIVER

BACKGROUND OF THE INVENTION

1. Field of the Invention

The present invention relates to a display panel driver for driving a display panel and, in particular, to a display panel driver for receiving video signals in accordance with a low-voltage differential method.

2. Description of the Related Art

An interface of a conventional liquid crystal display apparatus transmits respective bits of RGB video signals, horizontal synchronous signals, vertical synchronous signals and data enable signals in parallel at an amplitude voltage of 5 V or +3.3 V. However, as the resolution of recent liquid display panels has increased, the number of interfaces and the frequency of transmitted signals has increased. As a result, problems including electromagnetic interface (EMI) noise may occur. The number of interfaces has increased because, in order to transfer 24-bit data, for example, 51 signal lines including 48 (=24×2) signal lines and signal lines for control signals are required. If GND lines are included therein, about 60 signal lines are required in total. Generally speaking, at the amplitude voltage of +5 V or +3.3 V, 30 MHz is the limit of the transmitting frequency. Thus, in order to reduce the number of interfaces and to protect against EMI, a low-voltage differential signaling method such as Low Voltage Differential Signaling (LVDS) has been proposed and has become commercially practical. In LVDS, the video signals, synchronous signals and data enable signals having been transmitted in parallel are serialized and transferred at a higher speed than the transfer rate of the original video signals and at a lower voltage amplitude.

A liquid crystal display apparatus using the conventional LVDS as an interface includes an LVDS receiver IC, a timing controller IC, multiple source driver ICs, and multiple gate driver ICs. The LVDS receiver IC receives LVDS signals including video signal data and synchronous signal data and retrieves video signals, synchronous signals, clock signals and data enable signals from the LVDS signals. Then, the LVDS receiver IC converts the video signals, synchronous signals, clock signals and data enable signals to TTL/CMOS signals. The timing controller IC generates display signals and display control signals from the TTL/CMOS signals. The multiple source driver ICs generate and output drive signals for driving signal lines of the liquid crystal panel based on the display signals and the display control signals. The multiple gate driver ICs generate and output drive signals for driving scan lines of the liquid crystal panel based on the display control signals. However, in this case, the TTL/CMOS signals are generally transmitted through about 24 transmission lines connecting from the timing controller IC to the source driver ICS. Therefore, an area for the wiring is required, and EMI noise is radiated from the transmission lines, both of which are problems.

In order to solve these problems, a liquid crystal display apparatus has been proposed (as disclosed in Japanese Unexamined Patent Application Publication No. 2000-152130) which adopts a low-voltage differential signaling method for the interface between a timing controller IC and source driver ICs.

However, in order to increase the resolution of a liquid crystal panel and the transfer speed of transmitted data between the timing controller and the signal line driver, the number of transmission lines must be increased because of the upper limit of the transfer frequency of the transmission lines or the operational frequency of the transmit/receive circuit. Therefore, the problem of increased EMI noise due to the increases in size of the wiring space and in the number of wires becomes more significant. In addition, currently, a further reduction in the size of a non-display area surrounding a liquid crystal panel of a liquid crystal display apparatus is in demand. Thus, the existence of the wiring space surrounding the liquid crystal panel and a connection substrate around the liquid crystal panel becomes a problem.

SUMMARY OF THE INVENTION

It is an object of the invention to provide a display panel driver which can suppress the occurrence of EMI noise and can reduce the implementation space around a display panel.

According to one aspect of the present invention, there is provided a display panel driver, including an interface for receiving low voltage differential signals and retrieving video signals, synchronous signals, clock signals and control signals from the low voltage differential signals, a timing controller for generating a display control signal based on the synchronous signals, clock signals and control signals retrieved by the interface, and a signal line driving portion for generating and outputting driving signals for driving signal lines of a display panel based on the video signals retrieved by the interface and the display control signal generated by the timing controller. In this case, the relationship $L1 \leqq V(F1 \times \in 1^{1/2} \times 100)$ is satisfied where a transmission path length between the interface and the timing controller is L1, a propagating speed of electromagnetic waves in a vacuum is V, a frequency of a signal transmitted between the interface and the timing controller is F1, and a comparative dielectric constant of a transmission path medium between the interface and the timing controller is $\in 1$. The relationship $L2 \leqq V(F2 \times \in 2^{1/2} \times 100)$ is satisfied where a transmission path length between the timing controller and the signal driving portion is L2, a propagating speed of electromagnetic waves in a vacuum is V, a frequency of a signal transmitted between the timing controller and the signal line driving portion is F2, and a comparative dielectric constant of a transmission path medium between the timing controller and the signal line driving portion is $\in 2$.

The display panel driver may further include a display control signal output portion for outputting the display control signals generated by the timing controller to a scan line driving circuit for driving scan lines of the display panel.

In this case, the display control signals output from the control signal output portion may be low voltage differential signals.

The display control signals output from the control signal output portion may be TTL/CMOS signals.

Preferably the interface, the timing controller and the signal line driving portion are provided on a substrate of the display panel.

The display panel driver may further include a phase demultiplexer for demultiplexing the video signals retrieved by the interface to lower a frequency thereof by 1/n multiplying. In this case, the signal line driving portion may generate and output the driving signals for driving the signal lines based on video signals phase-demulstiplexed by the phase demultiplexer.

Here, the relationship $L3 \leqq V(F3 \times \in 3^{1/2} \times 100)$ is preferably satisfied where a transmission path length between the phase demultiplexer and the signal line driving portion is L3, a propagating speed of electromagnetic waves in a vacuum is V, a frequency of a signal transmitted between the phase demultiplexer and the signal line driving portion is F3, and a comparative dielectric constant of a transmission path medium between the phase demultiplexer and the signal line driving portion is ∈3.

The phase demultiplexer may be provided on a substrate of the display panel.

The display panel driver may be an integrated circuit.

Preferably, the integrated circuit is provided on a substrate of the display panel driver.

The integrated circuit may be provided along one side of the display panel, and the length of the display panel driver in a direction along the side of the display panel may be equal to the length of the side.

Preferably, a material of the substrate of the integrated circuit is the same as a material used for the substrate used for the display panel.

DESCRIPTION OF THE PREFERRED EMBODIMENTS

A display panel driver according to a first embodiment of the present invention will be described below with reference to FIGS. 1 to 4. According to the first embodiment, a display panel driver of the invention is applied as a liquid crystal driver for driving a liquid crystal panel with XGA (1024× 768 dots) resolution.

Figure 1:
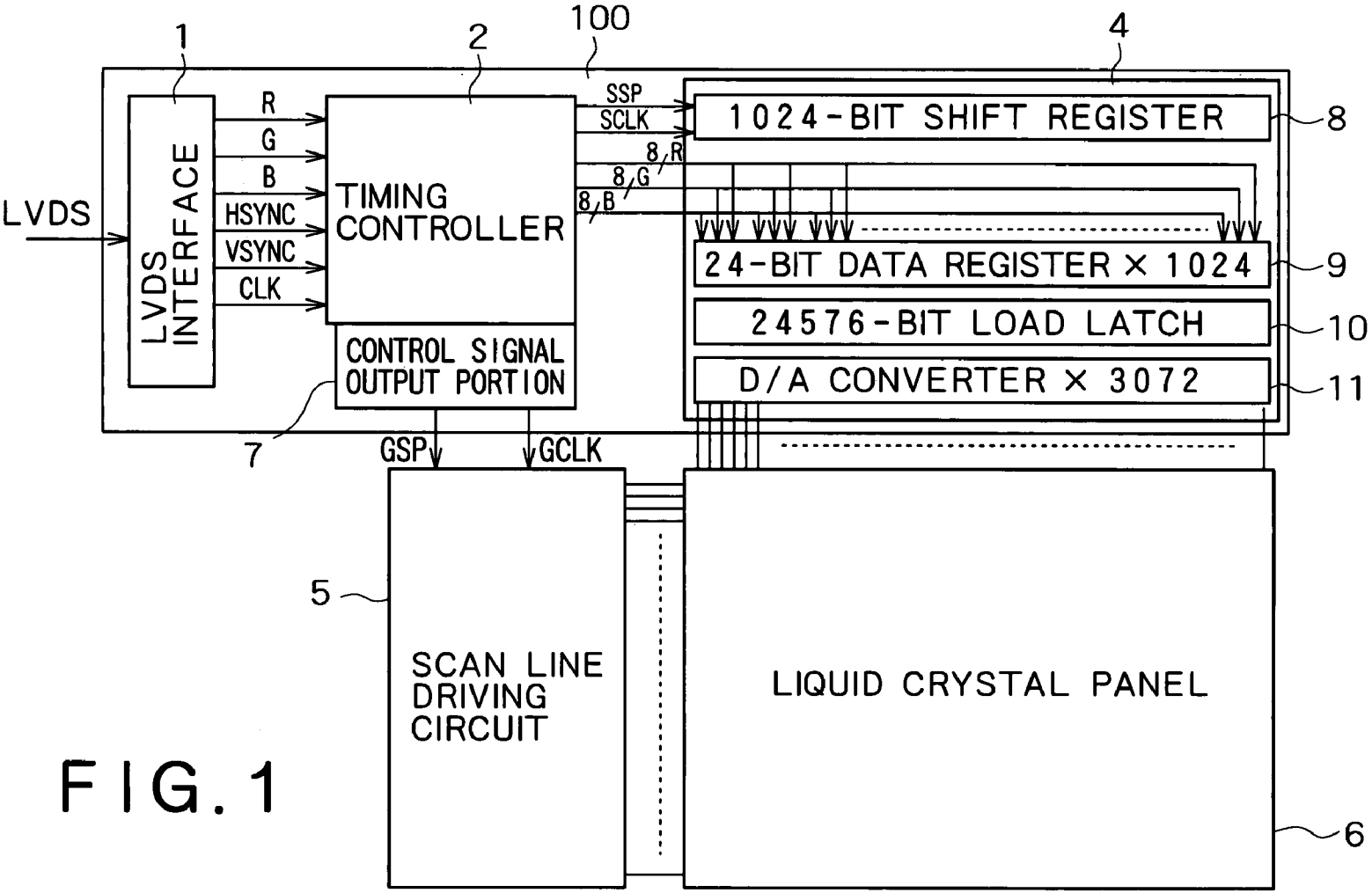
FIG. 1 is a block diagram showing a configuration of a display panel driver according to a first embodiment.

FIG. 1 is a block diagram showing a configuration of the display panel driver according to the first embodiment. As shown in FIG. 1, the display panel driver according to the first embodiment includes a signal line driving circuit 100 having an LVDS input interface 1, a timing controller 2, a signal line driving portion 4 and a control signal output portion 7 and a scan line driving circuit 5. The signal line driving portion 4 includes a 1024-bit shift register 8, 1024 24-bit data registers 9, a 24576-bit load latch 10, and 3072 8-bit converters 11. As described later, the signal line driving circuit 100 and the scan line driving circuit 5 are integrated circuits.

Next, operations of the display panel driver according to the first embodiment will be described.

LVDS signals are input from an external apparatus (not shown) to the LVDS input interface 1. The LVDS signals include video signals including 8-bit RGB video signals, horizontal synchronous signals, vertical synchronous signals, clock signals and data enable signals generated by an external apparatus. The LVDS input interface 1 receives the LVDS signals and retrieves and outputs the 8-bit RGB video signals, horizontal synchronous signals, vertical synchronous signals, clock signals and data enable signals from the LVDS signals. The timing controller 2 generates 8-bit RGB display signals, clocks SCLK for the signal line driving portion, start pulses SSP for the signal line driving portion, clocks GCLK for the scan line driving portion and start pulses GSP for the scan line driving portion based on the 8-bit RGB video signals, horizontal synchronous signals, vertical synchronous signals, clock signals and data enable signals output from the LVDS interface 1 and supplies the generated clocks and pulses to the signal line driving portion 4 and the control signal output portion 7.

Here, the 8-bit RGB display signals are signals in which video signals are arranged as required in accordance with the configuration of the signal line driving portion 4. The frequency of the clocks SCLK for the signal line driving portion is equal to the frequency of the clock signals retrieved from the LVDS signals. The start pulse SSP for the signal line driving portion is activated in synchronization with the time when the data enable signal retrieved from the LVDS signals is enabled. The frequency of the clocks GCLK for the scan line driving portion is equal to the frequency of the horizontal synchronous signals retrieved from the LVDS signals. The start pulse GSP for the scan line driving portion is activated in synchronization with the time when the vertical synchronous signal retrieved from the LVDS signals is activated.

From the 1024 output terminals of the 1024-bit shift register 8 of the signal line driving portion 4, latch signals are sequentially supplied to the 1024 24-bit registers 9 at a time determined based on the clock SCLK for the signal line driving portion and the start pulse SSP for the signal line driving portion.

At a time determined by the latch signal, 24-bit data registers 9 latch 8-bit RGB display signals. At a time in synchronization with the horizontal synchronous signal retrieved from the LVDS signals, the 24576-bit load latch 10 latches 8-bit RGB display signals output from the 1024 24-bit data registers 9 and supplies the result to the 3072 8-bit D/A converters 11.

The 8-bit D/A converter 11 converts the supplied 8-bit data to an analog signal voltage and generates a driving voltage for the signal lines of a liquid crystal panel 6. Then, the 8-bit D/A converter 11 applies the driving voltage sequentially to the signal lines of the liquid crystal panel 6.

On the other hand, the scan line driving circuit 5 receives the clock GCLK for the scan line driving portion 5 and start pulse GSP for the scan line driving portion 5 output through the control signal output portion 7 and applies a predetermined scan line driving voltage sequentially to the scan lines of the liquid crystal panel 6 at a time determined by the clock GCLK for the scan line driving portion 5 and start pulse GSP for the scan line driving portion 5. The clock GCLK for the scan line driving portion 5 and start pulse GSP for the scan line driving portion 5 output from the control signal output portion 7 may be low-voltage differential signals or may be TTL/CMOS signals.

Figure 2:
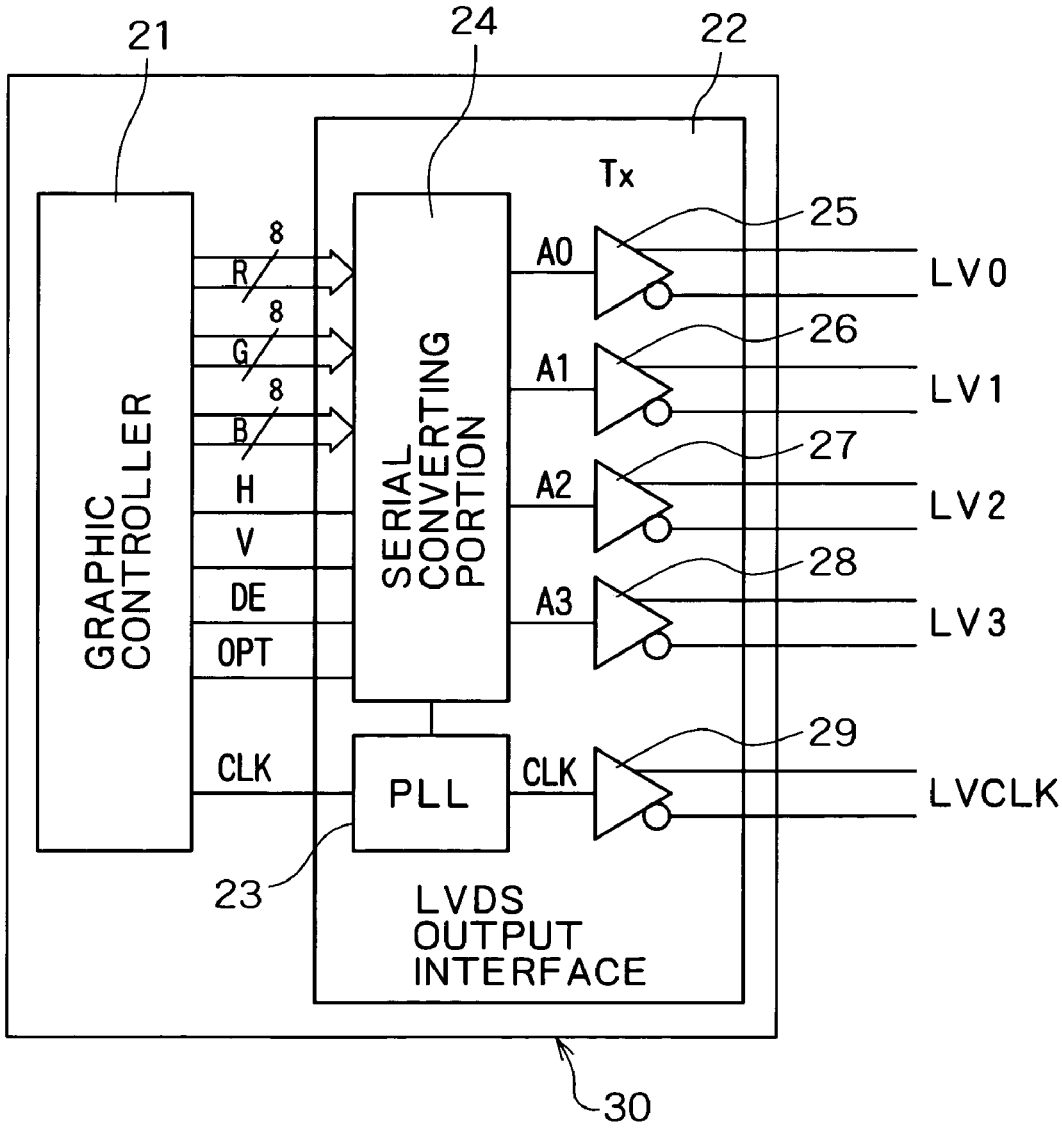
FIG. 2 is a block diagram showing an example configuration of an LVDS output interface of an external apparatus for sending LVDS signals to a liquid crystal panel driver.
Figure 3:
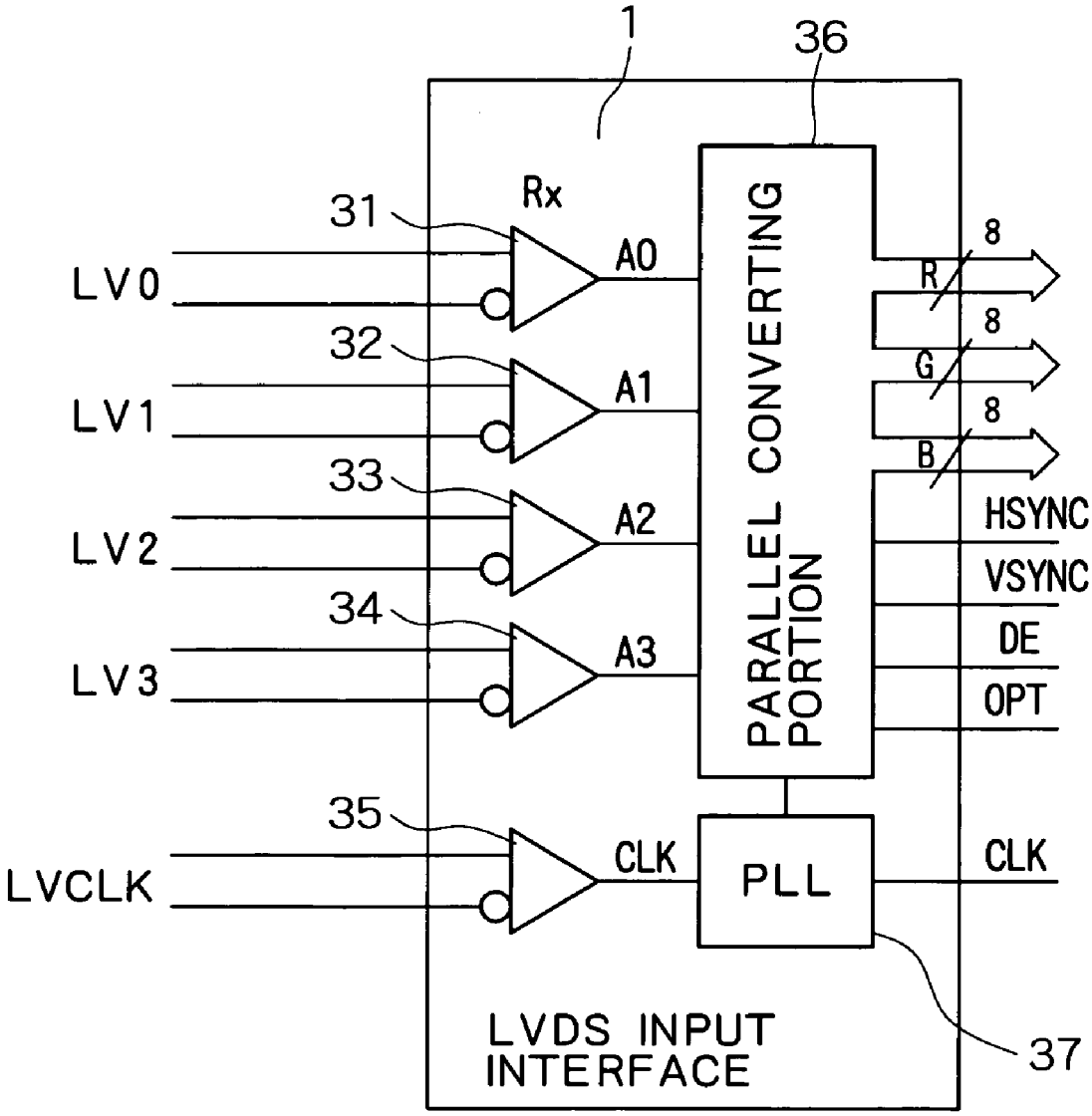
FIG. 3 is a block diagram showing an example configuration of an LVDS input interface of a liquid crystal panel driver.

FIG. 2 is a block diagram showing an example configuration of an LVDS output interface for an external apparatus for sending LVDS signals to the liquid crystal panel driver shown in FIG. 1. FIG. 3 is a block diagram showing a configuration example of the LVDS input interface 1 for the liquid crystal panel driver corresponding to the external apparatus 30 shown in FIG. 2.

The external apparatus 30 shown in FIG. 2 includes a graphic controller 21 and an LVDS output interface 22 for converting the video signals, horizontal synchronous signals and vertical synchronous signals output from the graphic controller 21 of the LVDS transmitting portion. The LVDS output interface 22 includes a PLL portion 23, a serial converting portion (serializer) 24, LVDS transmitting portions 25 to 28, and an LVDS transmitting portion 29. The PLL portion 23 generates clocks. The serial converting portion 24 converts parallel signals to serial signals. The LVDS transmitting portions 25 to 28 convert and output serial signals output from the serial converting portion 24 to LVDS signals. The LVDS transmitting portion 29 converts and outputs the clocks output from the PLL portion 24 to LVDS signals. The LVDS input interface 1 shown in FIG. 3 includes LVDS receiving portions 31 to 35, a parallel converting portion (deserializer) 36 and a PLL portion 37. The LVDS receiving portions 31 to 35 receive LVDS signals sent from the external apparatus 30. The parallel converting portion 36 converts serial signals to parallel signals. The PLL portion 37 generates clocks.

Next, operations of the external apparatus 30 and LVDS input interface 1 will be described.

The PLL portion 23 of the external apparatus 30 generates a new clock based on the clock output from the graphic controller 21. The LVDS output interface 22 converts the 8-bit RGB video signals, horizontal synchronous signals, vertical synchronous signals and data enable signals output from the graphic controller 21 to LVDS signals as well as the clocks based on the clocks output from the PLL portion 23. These five pairs of LVDS signals are output to the LVDS input interface 1 of the liquid crystal panel driver.

The LVDS signals sent from the external apparatus 30 are converted to TTL signals in the LVDS receiving portions 31 to 35 of the LVDS input interface 1. The clock output from the LVDS receiving portion 35 is supplied to the PLL portion 37. The PLL portion 37 generates a new clock based on the clock that the PLL portion 37 has received. The parallel converting portion 36 converts the TTL signals output from the LVDS receiving portions 31 to 35 to 8-bit RGB video signals, horizontal synchronous signals, vertical synchronous signals and data enable signals based on the clocks output from the PLL portion 37.

Figure 4:
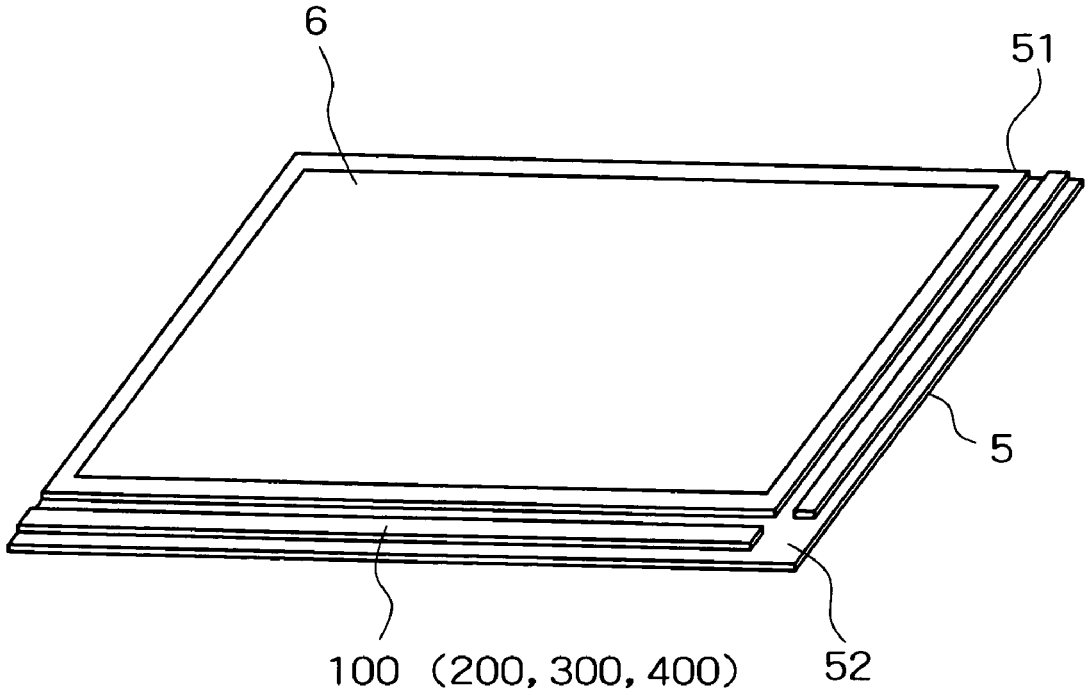
FIG. 4 is a perspective diagram showing an implementation method of a liquid crystal panel driver.

FIG. 4 is a perspective diagram of an implementation of a liquid crystal panel driver. As shown in FIG. 4, the liquid crystal panel 6 includes a substrate 51 and a substrate 52 which is larger than the substrate 51 disposed on the substrate 52. The signal line driving circuit 100 is an integrated circuit having a polysilicon FET disposed on a substrate having the same material as that of the substrate 52 and is disposed on the substrate 52. Thus, the temperature coefficient of the thermal expansion rate of the substrate of the integrated circuit is equal to that of the substrate 52 of the liquid crystal panel 6, which prevents occur distortions, for example, of the substrates after both of the substrates are pasted to each other. Therefore, direct defects such as an increase in contact resistance and/or a decrease in reliability due to the occurrence of stress and so on can be prevented.

The longitudinal width of the substrate of the signal line driving circuit 100 is substantially the same as the length of the long side of the substrate 51. The signal lines of the liquid crystal panel 6 are connected to the output terminals of the signal line driving circuit 100 through a connecting line (not shown) on the substrate 52. In this way, one integrated circuit along the long side of the substrate 51 allows the transmission of driving signals to all of the signal lines. Thus, the manufacturing cost can be reduced, and the defect rate is lower than that in the case of using many IC chips. Therefore, the yield in the production processes of the liquid crystal panel can be increased. When the integrated circuit of the signal line driving circuit 100 is provided along the entire long side of the substrate 51, the wire from the signal line driving circuit 100 to the liquid crystal panel 6 can be the shortest. Therefore, the implementation space required around the display area can be reduced.

According to the first embodiment, the scan line driving circuit 5 is formed as an integrated circuit by creating a polysilicon FET disposed on a substrate having the same material as that of the substrate 52 and is implemented on the substrate 52. The longitudinal width of the substrate of the scan line driving circuit 5 is substantially the same as the length of the short side of the substrate 51. The scan lines of the liquid crystal panel 6 are connected to output terminals of the scan line driving circuit 5 through a connecting line (not shown) on the substrate 52.

Furthermore, according to the first embodiment, the relationship $$L11 \leqq V(F11 \times \in 11^{1/2} \times 100)$$

is satisfied where a transmission path length between the LVDS interface 1 and the timing controller 2 is L11, a propagating speed of electromagnetic waves in a vacuum is V, a frequency of a signal transmitted between the interface 1 and the timing controller 2 is F11, and a comparative dielectric constant of a transmission path medium between the interface 1 and the timing controller 2 is ∈11.

The relationship $L12 \leqq V(F12 \times \in 12^{1/2} \times 100)$ is satisfied where a transmission path length between the timing controller 2 and the signal line driving portion 4 is L12, a propagating speed of electromagnetic waves in a vacuum is V, a frequency of a signal transmitted between the timing controller 2 and the signal line driving portion 4 is F12, and a comparative dielectric constant of a transmission path medium between the timing controller 2 and the signal line driving portion 4 is ∈12.

Thus, the EMI noise based on the signal transmission between the LVDS interface 1 and the timing controller 2 or the signal transmission between the timing controller 2 and the signal line driving portion 4 can be suppressed. Therefore, faulty operation due to the EMI noise and so on can be effectively prevented.

A display panel driver according to a second embodiment of the invention will be described below with reference to FIGS. 5 to 7. According to the second embodiment, a display panel driver of the invention is applied to a liquid crystal panel driver for driving a liquid crystal panel with XGA (1024×768 dots) resolution. The second embodiment will be described mainly with reference to these features that differ from the first embodiment.

Figure 5:
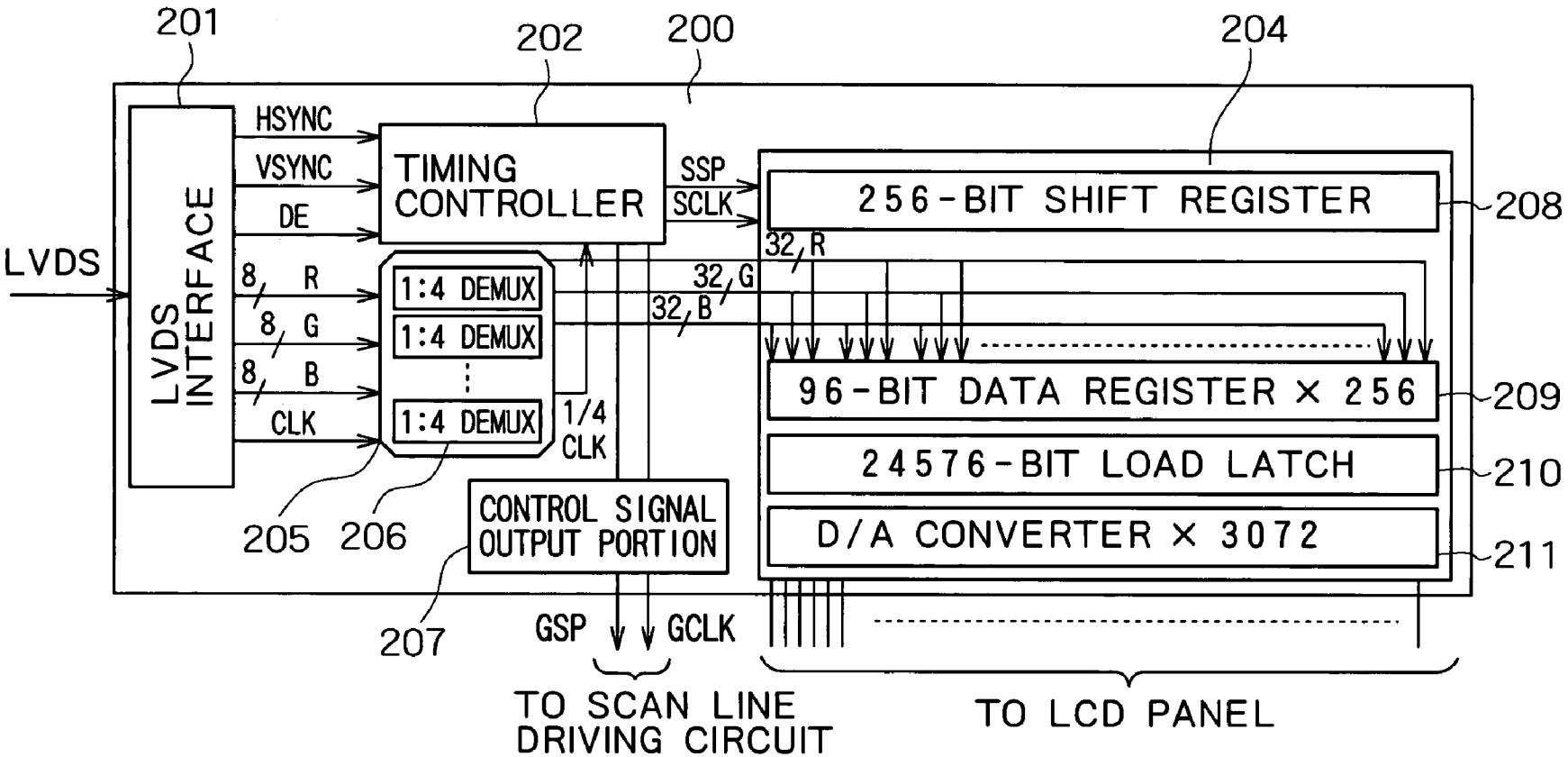
FIG. 5 is a block diagram showing a configuration of a display panel driver according to a second embodiment.

FIG. 5 is a block diagram showing a configuration of a liquid crystal display apparatus, which is a display panel driver according to the second embodiment. Since the scan line driving circuit has the same construction as that of the first embodiment, the description will be omitted here.

As shown in FIG. 5, the liquid crystal driver includes a signal line driving circuit 200 having an LVDS input interface 201, a timing controller 202, a signal line driving portion 204, a 1:4 phase demultiplexer 205 and a control signal output portion 207. The signal line driving portion 204 includes a 256-bit shift register 208, 256 96-bit data registers 209, a 24576-bit load latch 210, and 3072 8-bit D/A converters 211. Like the first embodiment, the signal line driving circuit 200 is an integrated circuit.

As shown in FIG. 5, the 1:4 phase demultiplexer 205 includes 32 1:4 phase demultiplexing circuits 206. The phase demultiplexer 205 demultiplexes the video signals retrieved by the interface and lower a frequency thereof by 1/n multiplying (n is a natural number).

Figure 6:
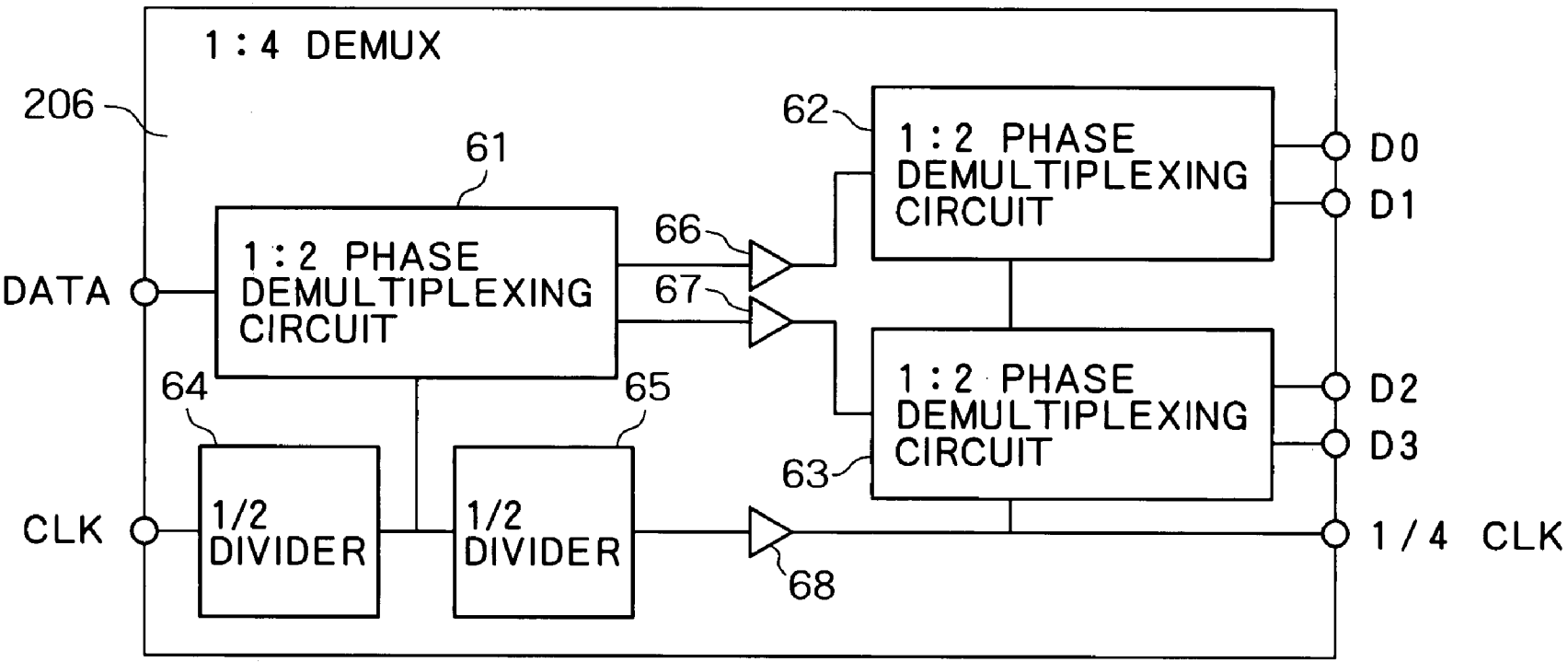
FIG. 6 is a block diagram showing a configuration of a 1:4 phase demultiplexing circuit.

FIG. 6 is a block diagram showing a configuration of the 1:4 phase demultiplexing circuit 206. A shown in FIG. 6, the 1:4 phase demultiplexing circuit 206 includes 1:2 phase demultiplexing circuits 61 to 63, ½ dividers 64 and 65 and buffers 66 to 68.

Figure 7:
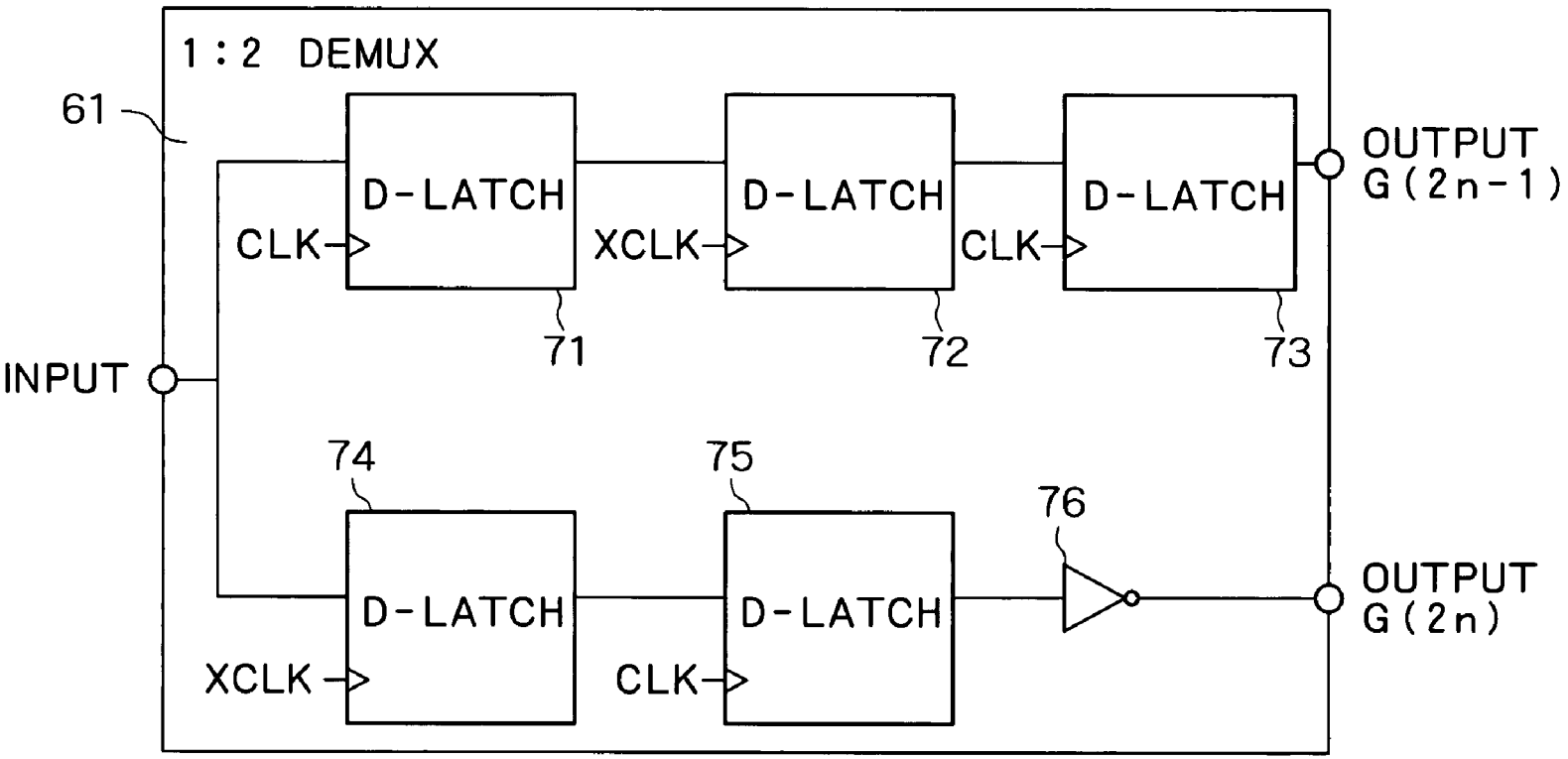
FIG. 7 is a block diagram showing a configuration of a 1:2 phase demultiplexing circuit.

FIG. 7 is a block diagram showing a configuration of the 1:2 phase demultiplexing circuit 61. As shown in FIG. 7, the 1:2 phase demultiplexing circuit 61 includes D-latches 71 to 75 and a buffer 76. Each of the 1:2 phase demultiplexing circuits 62 to 63 has the same construction as that of the 1:2 phase demultiplexing circuit 61.

The driver according to the second embodiment adopts the same structure as that of the first embodiment, as shown in FIG. 4 for the first embodiment. In other words, according to the second embodiment, instead of the integrated circuit as the signal driving circuit 100, an integrated circuit as the signal line driving circuit 200 is implemented on the substrate 52.

Next, operations of the liquid crystal panel driver according to the second embodiment will be described.

LVDS signals are input from an external apparatus (not shown) to the LVDS input interface 201. The LVDS signals include the 8-bit RGB video signals, horizontal synchronous signals, vertical synchronous signals, clock signals and data enable signals generated by the external apparatus. The LVDS interface 201 receives the LVDS signals and retrieves and outputs the 8-bit RGB video signals, horizontal synchronous signals, vertical synchronous signals, clock signals and data enable signals retrieved from the LVDS signals. The 1:4 phase demultiplexer 205 converts 8-bit RGB video signals output from the LVDS input interface 201 to 32-bit-each RGB video signals parallel-expanded into four. Here, 1 bit of an 8-bit RGB signal and a clock signal output from the LVDS input interface 201 are input to each 1:4 phase demultiplexing circuit 206 (FIG. 6). Then, the 1:4 phase demultiplexing circuit 206 outputs a ¼ clock signal of ¼ frequency of the input clock signal and a video signal, which is synchronous with the ¼ clock signal and is parallel-expanded into four.

The timing controller 202 generates clocks SCLK for the signal line driving portion, start pulses SSP for the signal line driving portion, clocks GCLK for the scan line driving portion and start pulses GSP for the scan line driving portion based on the horizontal synchronous signals, vertical synchronous signals and data enable signals output from the LVDS input interface 201 and the ¼ clock signal output from the 1:4 phase demultiplexer 205. Then, the timing controller 202 supplies the clocks SCLK for the signal line driving portion, start pulses SSP for the signal line driving portion, clocks GCLK for the scan line driving portion and start pulses GSP for the scan line driving portion to the signal line driving portion 204 and a control signal output portion 207.

Here, the frequency of the clocks SCLK for the signal line driving portion is equal to the frequency of the ¼ clocks output from the 1:4 phase demultiplexer 205. The start pulse SSP for the signal line driving portion is activated in synchronization with the time when the data enable signal retrieved from the LVDS signals is enabled. The frequency of the clocks GCLK for the scan line driving portion is equal to the frequency of the horizontal synchronous signals retrieved from the LVDS signals. The start pulse GSP for the scan line driving portion is activated in synchronization with the time when the vertical synchronous signal retrieved from the LVDS signals is activated.

From the 256 output terminals of the 256-bit shift register 208 of the signal line driving portion 204, latch signals are sequentially supplied to 256 96-bit registers 209 at a time determined based on the clock SCLK for the signal line driving portion and the start pulse SSP for the signal line driving portion.

At a time determined by the latch signal, 96-bit data registers 209 latch 8-bit RGB display signals. At a time in synchronization with the horizontal synchronous signal retrieved from the LVDS signals, the 24576-bit load latch 210 latches 8-bit RGB display signals output from the 256 96-bit data registers 209 and supplies the result to 3072 8-bit D/A converters 211.

The 8-bit D/A converter 211 converts the supplied 8-bit data to an analog signal voltage and generates a driving voltage for the signal lines of the liquid crystal panel (not shown). Then, the 8-bit D/A converter 11 applies the driving voltage sequentially to the signal lines of the liquid crystal panel.

On the other hand, the scan line driving circuit (not shown) receives the clock GCLK for the scan line driving portion and start pulse GSP for the scan line driving portion output through the control signal output portion 207 and applies a predetermined scan line driving voltage sequentially to the scan lines of the liquid crystal panel at a time determined by the clock GCLK for the scan line driving portion and start pulse GSP for the scan line driving portion. The clock GCLK for the scan line driving portion and start pulse GSP for the scan line driving portion output from the control signal output portion 207 may be low-voltage differential signals or may be TTL/CMOS signals.

According to the second embodiment, like the first embodiment, the signal line driving circuit 200 is an integrated circuit having a polysilicon FET disposed on a substrate having a same material as that of the substrate 52 and is implemented on the substrate 52 (see FIG. 4). Thus, the temperature coefficient of the thermal expansion rate of the substrate of the integrated circuit is equal to that of the substrate 52 of the liquid crystal panel. Therefore, direct defects such as an increase in contact resistance and/or a decrease in reliability due to the occurrence of stress and so on can be prevented. The longitudinal width of the substrate of the integrated circuit as the signal line driving circuit 200 is substantially the same as the length of the long side of the substrate 51. The integrated circuit is disposed along the long side of the substrate 51. Thus, the manufacturing cost can be reduced. In addition, the yield in the production processes of the liquid crystal panel can be increased. Therefore, the implementation space required around the display area can be reduced.

Furthermore, according to the second embodiment, the relationship $$L21 \leqq V(F21 \times \in 21^{1/2} \times 100)$$

is satisfied where a transmission path length between the LVDS interface 201 and the timing controller 202 is L21, a propagating speed of electromagnetic waves in a vacuum is V, a frequency of a signal transmitted between the interface 201 and the timing controller 202 is F21, and a comparative dielectric constant of a transmission path medium between the interface 201 and the timing controller 202 is ∈21.

The relationship $$L22 \leqq V(F22 \times \in 22^{1/2} \times 100)$$

is satisfied where a transmission path length between the timing controller 202 and the signal line driving portion 204 is L22, a propagating speed of electromagnetic waves in a vacuum is V, a frequency of a signal transmitted between the timing controller 202 and the signal line driving portion 204 is F22, and a comparative dielectric constant of a transmission path medium between the timing controller 202 and the signal line driving portion 204 is ∈22.

The relationship $$L23 \leqq V(F23 \times \in 23^{1/2} \times 100)$$

is satisfied where a transmission path length between the 1:4 phase demultiplexer 205 and the signal line driving portion 204 is L23, a propagating speed of electromagnetic waves in a vacuum is V, a frequency of a signal transmitted between the 1:4 phase demultiplexer 205 and the signal line driving portion 204 is F23, and a comparative dielectric constant of a transmission path medium between the 1:4 phase demultiplexer 205 and the signal line driving portion 204 is ∈23.

Thus, the EMI noise based on the signal transmission between the LVDS interface 201 and the timing controller 202, the signal transmission between the timing controller 202 and the signal line driving portion 204 or the signal transmission between the 1:4 phase demultiplexer 205 and the signal line driving portion 204 can be suppressed. Therefore, faulty operation due to the EMI noise and so on can be effectively prevented.

A display panel driver according to a third embodiment of the invention will be described below with reference to FIG. 8. According to the third embodiment, a display panel driver of the invention is applied to a liquid crystal panel driver for driving a liquid crystal panel with XGA (1024×768 dots) resolution. The third embodiment will be described mainly with reference to these features that differ from the second embodiment.

Figure 8:
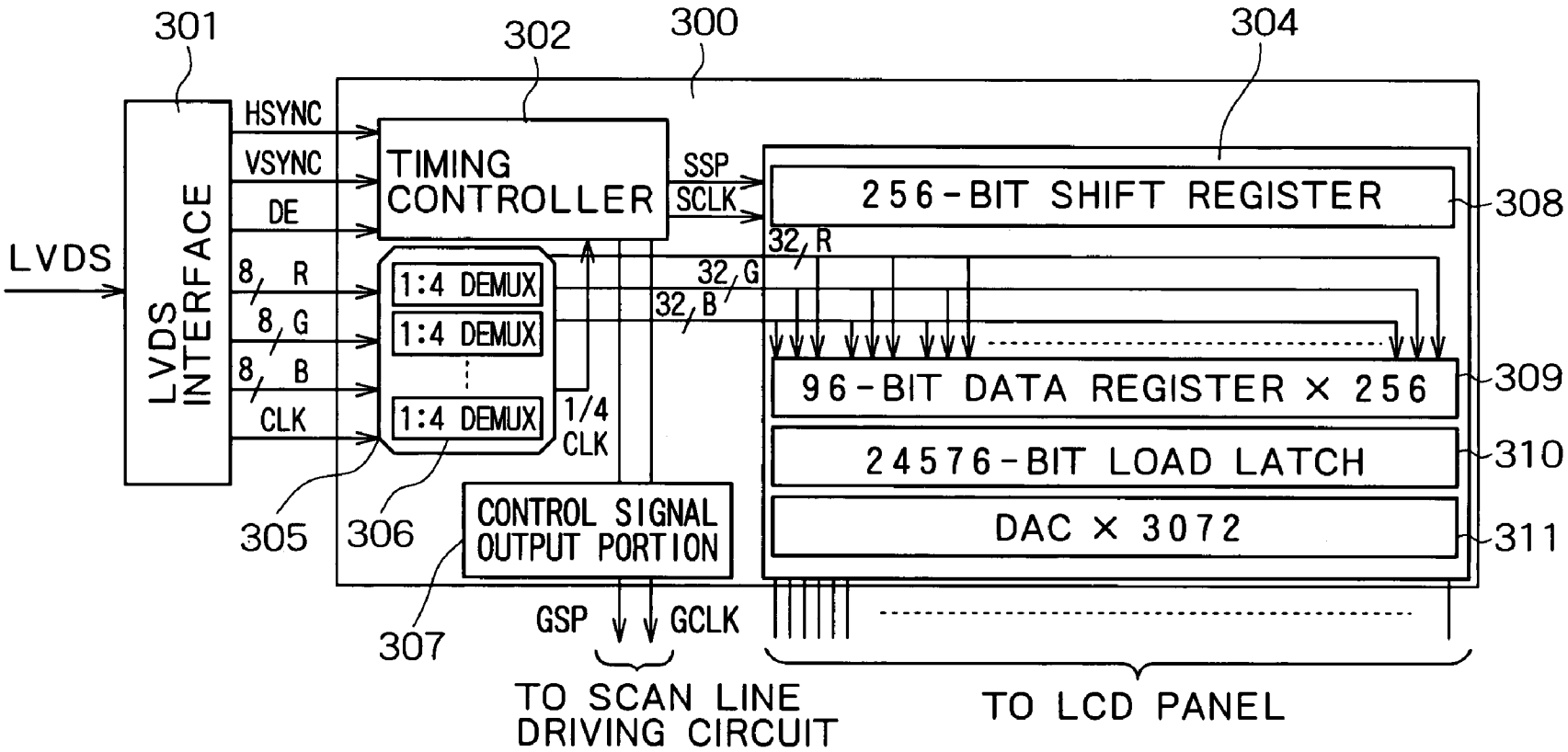
FIG. 8 is a block diagram showing a configuration of a display panel driver according to a third embodiment.

FIG. 8 is a block diagram showing a configuration of a liquid crystal display apparatus, which is a display panel driver according to the third embodiment. Since the scan line driving circuit has the same construction as that of the second embodiment, the description will be omitted here. As shown in FIG. 8, the liquid crystal driver includes an LVDS input interface 301 and a signal line driving circuit 300 as an integrated circuit.

The signal line driving circuit 300 includes a timing controller 302, a signal line driving portion 304, a 1:4 phase demultiplexer 305 and a control signal output portion 307. The signal line driving portion 304 includes a 256-bit shift register 308, 256 96-bit data registers 309, a 24576-bit load latch 310 and 3072 8-bit D/A converters 311. The 1:4 phase demultiplexer 305 has the same construction as that of the 1:4 phase demultiplexer 205 according to the second embodiment.

The driver according to the third embodiment adopts the same structure as that of the second embodiment, as shown in FIG. 4 with respect to the signal line driving circuit 300 and the scan line driving circuit. In other words, according to the third embodiment, instead of the integrated circuit as the signal driving circuit 200, an integrated circuit as the signal line driving circuit 300 is implemented. Furthermore, an LVDS input interface 301 (not shown) is also implemented on the substrate 52.

Next, operations of the liquid crystal panel driver according to the third embodiment will be described.

LVDS signals are input from an external apparatus (not shown) to the LVDS input interface 301. The LVDS signals include the 8-bit RGB video signals, horizontal synchronous signals, vertical synchronous signals, clock signals and data enable signals generated by the external apparatus. The LVDS interface 301 receives the LVDS signals and outputs, as TTL/CMOS signals, the 8-bit RGB video signals, horizontal synchronous signals, vertical synchronous signals, clock signals and data enable signals retrieved from the LVDS signals. The 1:4 phase demultiplexer 305 of the signal line driving circuit 300 converts 8-bit RGB video signals output from the LVDS input interface 301 to 32-bit-each RGB video signals parallel-expanded into four.

The timing controller 302 of the signal line driving circuit 300 generates clocks SCLK for the signal line driving portion, start pulses SSP for the signal line driving portion, clocks GCLK for the scan line driving portion and start pulses GSP for the scan line driving portion based on the horizontal synchronous signals, vertical synchronous signals and data enable signals output from the LVDS input interface 301 and the ¼ clock signal output from the 1:4 phase demultiplexer 305. Then, the timing controller 302 supplies the clocks SCLK for the signal line driving portion, start pulses SSP for the signal line driving portion, clocks GCLK for the scan line driving portion and start pulses GSP for the scan line driving portion to the signal line driving portion 304 and the control signal output portion 307.

Here, the frequency of the clocks SCLK for the signal line driving portion is equal to the frequency of the ¼ clocks output from the 1:4 phase demultiplexer 305. The start pulse SSP for the signal line driving portion is activated in synchronization with the time when the data enable signal retrieved from the LVDS signals is enabled. The frequency of the clocks GCLK for the scan line driving portion is equal to the frequency of the horizontal synchronous signals retrieved from the LVDS signals. The start pulse GSP for the scan line driving portion is activated in synchronization with the time when the vertical synchronous signal retrieved from the LVDS signals is activated.

From the 256 output terminals of the 256-bit shift register 308 of the signal line driving portion 304, latch signals are sequentially supplied to the 256 96-bit registers 309 at a time determined based on the clock SCLK for the signal line driving portion and the start pulse SSP for the signal line driving portion.

At a time determined by the latch signal, 96-bit data registers 309 latch 8-bit RGB display signals. At a time in synchronization with the horizontal synchronous signal retrieved from the LVDS signals, the 24576-bit load latch 310 latches 8-bit RGB display signals output from the 256 96-bit data registers 309 and supplies the result to 3072 8-bit D/A converters 311.

The 8-bit D/A converter 311 converts the supplied 8-bit data to an analog signal voltage and generates a driving voltage for the signal lines of the liquid crystal panel (not shown). Then, the 8-bit D/A converter 11 applies the driving voltage sequentially to the signal lines of the liquid crystal panel.

On the other hand, the scan line driving circuit (not shown) receives the clock GCLK for the scan line driving portion and start pulse GSP for the scan line driving portion output through the control signal output portion 307 and applies a predetermined scan line driving voltage sequentially to the scan lines of the liquid crystal panel at a time determined by the clock GCLK for the scan line driving portion and start pulse GSP for the scan line driving portion.

According to the third embodiment, like the second embodiment, the signal line driving circuit 300 is an integrated circuit having a polysilicon FET disposed on a substrate having the same material as that of the substrate 52 and is implemented on the substrate 52 (see FIG. 4). Thus, the temperature coefficient of the thermal expansion rate of the substrate of the integrated circuit is equal to that of the substrate 52 of the liquid crystal panel. Therefore, direct defects such as an increase in contact resistance and/or a decrease in reliability due to the occurrence of stress and so on can be prevented. The longitudinal width of the integrated circuit as the signal line driving circuit 300 is substantially the same as the length of the long side of the substrate 51. The integrated circuit is disposed along the long side of the substrate 51. Thus, the manufacturing cost can be reduced. In addition, the yield in the production processes of the liquid crystal panel can be increased. Also, the implementation space required around the display area can be reduced.

Furthermore, according to the third embodiment, the relationship $$L31 \leqq V(F31 \times \in 31^{1/2} \times 100)$$

is satisfied where a transmission path length between the LVDS interface 301 and the timing controller 302 is L31, a propagating speed of electromagnetic waves in a vacuum is V, a frequency of a signal transmitted between the interface 301 and the timing controller 302 is F31, and a comparative dielectric constant of a transmission path medium between the interface 301 and the timing controller 302 is ∈31.

The relationship $$L32 \leqq V(F32 \times \in 32^{1/2} \times 100)$$

is satisfied where a transmission path length between the timing controller 302 and the signal line driving portion 304 is L32, a propagating speed of electromagnetic waves in a vacuum is V, a frequency of a signal transmitted between the timing controller 302 and the signal line driving portion 304 is F32, and a comparative dielectric constant of a transmission path medium between the timing controller 302 and the signal line driving portion 304 is ∈32.

The relationship $$L33 \leqq V(F33 \times \in 33^{1/2} \times 100)$$

is satisfied where a transmission path length between the 1:4 phase demultiplexer 305 and the signal line driving portion 304 is L33, a propagating speed of electromagnetic waves in a vacuum is V, a frequency of a signal transmitted between the 1:4 phase demultiplexer 305 and the signal line driving portion 304 is F33, and a comparative dielectric constant of a transmission path medium between the 1:4 phase demultiplexer 305 and the signal line driving portion 304 is ∈33.

Thus, the EMI noise based on the signal transmission between the LVDS interface 301 and the timing controller 302, the signal transmission between the timing controller 302 and the signal line driving portion 304 or the signal transmission between the 1:4 phase demultiplexer 305 and the signal line driving portion 304 can be suppressed. Therefore, faulty operation due to the EMI noise and so on can be effectively prevented.

A display panel driver according to a fourth embodiment of the present invention will be described below with reference to FIGS. 9 and 10. According to the fourth embodiment, a display panel driver of the invention is applied to a liquid crystal driver for driving a liquid crystal panel with XGA (1024×768 dots) resolution. The fourth embodiment will be described mainly with reference to these features that differ from the second embodiment.

Figure 9:
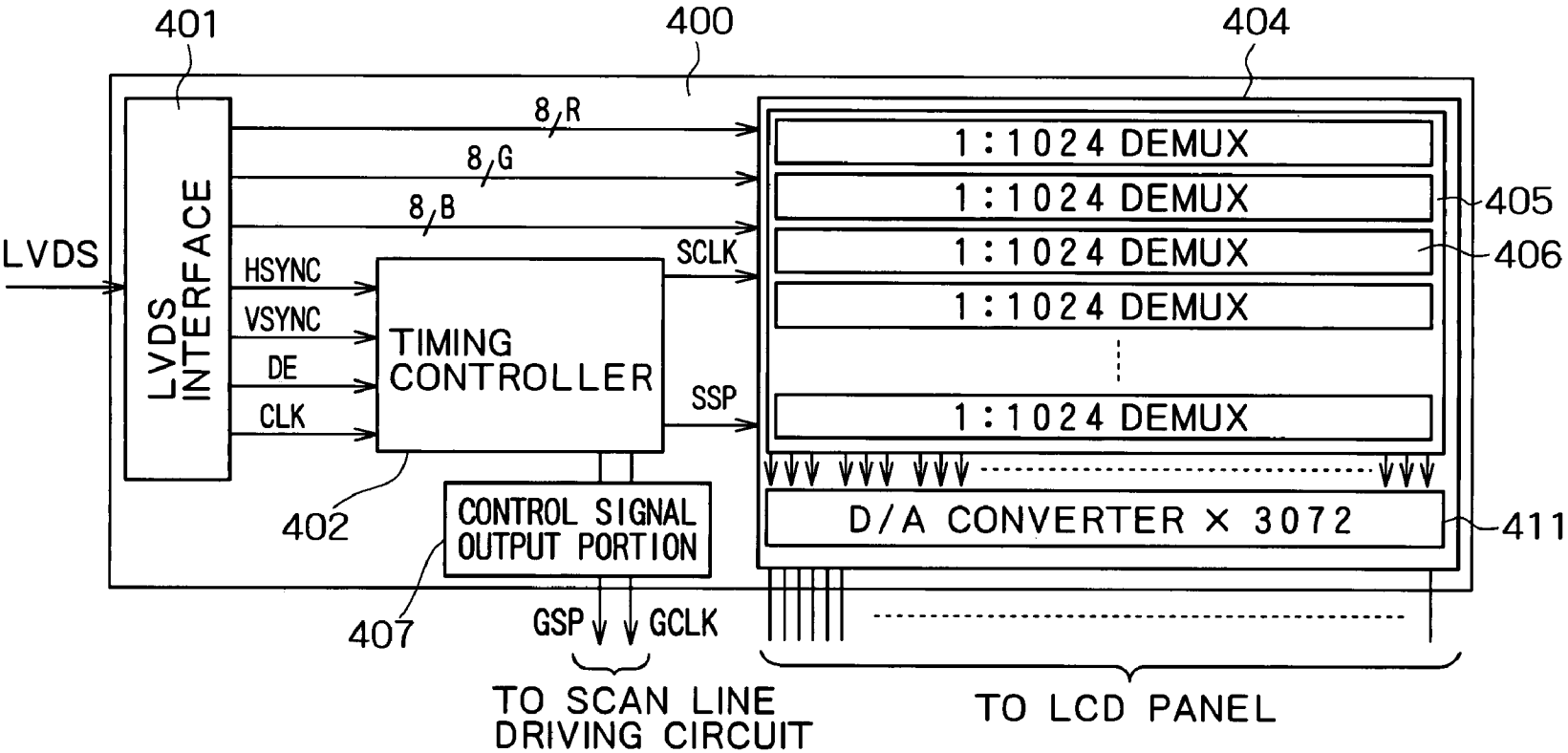
FIG. 9 is a block diagram showing a configuration of a display panel driver according to a fourth embodiment.

FIG. 9 is a block diagram showing a configuration of a display panel driver according to the fourth embodiment. Since the scan line driving circuit has the same construction as that of the second embodiment, the description will be omitted here. AS shown in FIG. 9, the display panel driver includes a signal line driving circuit 400 having an LVDS input interface 401, a timing controller 402, a signal line driving portion 404 and a control signal output portion 407. The signal line driving portion 404 includes a 1:1024 phase demultiplexer 405 and 3072 8-bit D/A converter 411. As shown in FIG. 9, the 1:1024 phase demultiplexer 405 includes 32 1:1024 expansion circuits. Like the second embodiment, the signal line driving circuit 400 is an integrated circuit.

Figure 10:
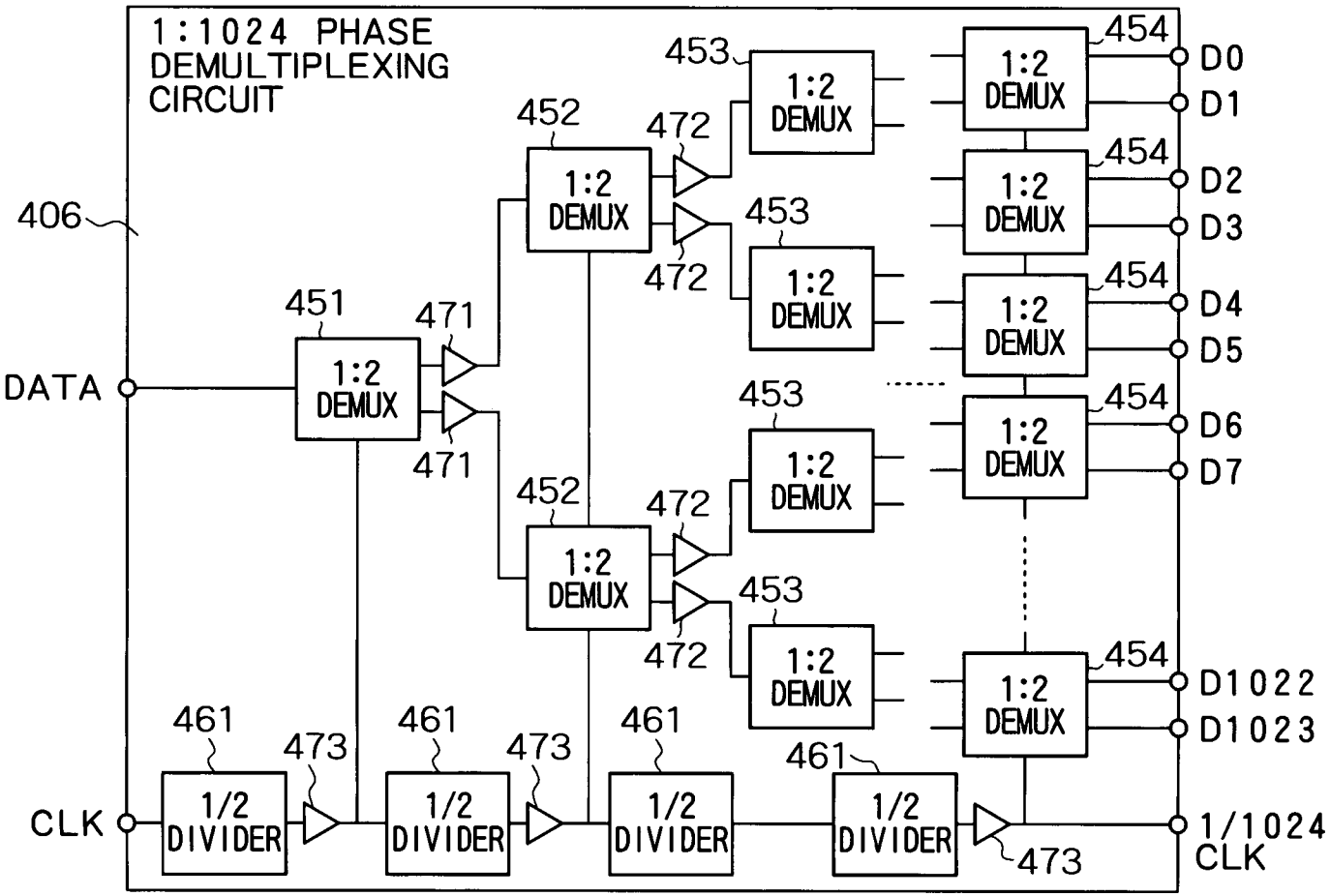
FIG. 10 is a block diagram showing a configuration of a 1024 phase demultiplexing circuit.

FIG. 10 is a block diagram of a configuration of the 1:1024 phase demultiplexing circuit 406. As shown in FIG. 10, the 1:1024 phase demultiplexing circuit 406 includes 1:2 phase demultiplexing circuits 451 to 454, ½ dividers 461 and buffers 471 to 473.

The driver according to the fourth embodiment adopts the same structure as that of the second embodiment, as shown in FIG. 4. In other words, according to the fourth embodiment, instead of the integrated circuit as the signal driving circuit 200, an integrated circuit as the signal line driving circuit 400 is implemented on the substrate 52.

Next, operations of the display panel driver according to the fourth embodiment will be described.

LVDS signals are input from an external apparatus (not shown) to the LVDS input interface 401. The LVDS signals include video signals including 8-bit RGB video signals, horizontal synchronous signals, vertical synchronous signals, clock signals and data enable signals generated by an external apparatus. The LVDS input interface 401 receives the LVDS signals and retrieves and outputs the 8-bit RGB video signals, horizontal synchronous signals, vertical synchronous signals, clock signals and data enable signals from the LVDS signals.

The timing controller 402 generates clocks SCLK for the signal line driving portion, start pulses SSP for the signal line driving portion, clocks GCLK for the scan line driving portion and start pulses GSP for the scan line driving portion based on the horizontal synchronous signals, vertical synchronous signals and data enable signals output from the LVDS input interface 401 and supplies the generated clocks and pulses to the signal line driving portion 404 and the control signal output portion 407.

Here, the start pulse SSP for the signal line driving portion is activated in synchronization with the time when the data enable signal retrieved from the LVDS signals is enabled. The frequency of the clocks GCLK for the scan line driving portion is equal to the frequency of the horizontal synchronous signals retrieved from the LVDS signals. The start pulse GSP for the scan line driving portion is activated in synchronization with the time when the vertical synchronous signal retrieved from the LVDS signals is activated.

The 1:1024 phase demultiplexer 405 of the signal line driving portion 404 generates 8192-bit-each RGB video signals resulting from the parallel expansion of 8-bit RGB video signals output from the LVDS input interface 401 into 1024 and supplies the 8192-bit-each RGB video signals to the 3072 8-bit D/A converter 411. Here, 1 bit of an RGB 8-bit signal and a clock are input to the 1:1024 phase demultiplexing circuit 406 of the 1:1024 phase demultiplexer 405. Then, the 1:1024 phase demultiplexing circuit 406 outputs a 1/1024 clock signal of 1/1024 frequency of the input clock signals and 8192-bit-each RGB video signals, which are synchronous with the 1/1024 clock signal and are parallel-expanded into 1024, to the 8-bit D/A converter 411.

The 8-bit D/A converter 411 converts the supplied 8-bit data to an analog signal voltage and generates a driving voltage for the signal lines of the liquid crystal panel (not shown). Then, the 8-bit D/A converter 411 applies the driving voltage sequentially to the signal lines of the liquid crystal panel.

On the other hand, a scan line driving circuit (not shown) receives the clock GCLK for the scan line driving portion and start pulse GSP for the scan line driving portion output through the control signal output portion 407 and applies a predetermined scan line driving voltage sequentially to the scan lines of the liquid crystal panel at a time determined by the clock GCLK for the scan line driving portion and start pulse GSP for the scan line driving portion. The clock GCLK for the scan line driving portion and start pulse GSP for the scan line driving portion output from the control signal output portion 407 may be low-voltage differential signals or may be TTL/CMOS signals.

According to the fourth embodiment, like the second embodiment, the signal line driving circuit 400 is an integrated circuit having a polysilicon FET disposed on a substrate having a same material as that of the substrate 52 and is implemented on the substrate 52 (see FIG. 4). Thus, the temperature coefficient of the thermal expansion rate of the substrate of the integrated circuit is equal to that of the substrate 52 of the liquid crystal panel. Therefore, direct defects such as an increase in contact resistance and/or a decrease in reliability due to the occurrence of stress and so on can be prevented. The longitudinal width of the integrated circuit as the signal line driving circuit 400 is substantially the same as the length of the long side of the substrate 51. The integrated circuit is disposed along the long side of the substrate 51. Thus, the manufacturing cost can be reduced. In addition, the yield in the production processes of the liquid crystal panel can be increased. Therefore, the implementation space required around the display area can be reduced.

Furthermore, according to the fourth embodiment, the relationship $$L41 \leqq V(F41 \times \in 41^{1/2} \times 100)$$

is satisfied where a transmission path length between the LVDS interface 401 and the timing controller 402 is L41, a propagating speed of electromagnetic waves in a vacuum is V, a frequency of a signal transmitted between the interface 401 and the timing controller 402 is F41, and a comparative dielectric constant of a transmission path medium between the interface 401 and the timing controller 402 is ∈41.

The relationship $$L42 \leqq V(F42 \times \in 42^{1/2} \times 100)$$

is satisfied where a transmission path length between the timing controller 402 and the signal line driving portion 404 is L42, a propagating speed of electromagnetic waves in a vacuum is V, a frequency of a signal transmitted between the timing controller 402 and the signal line driving portion 404 is F42, and a comparative dielectric constant of a transmission path medium between the timing controller 402 and the signal line driving portion 404 is ∈42.

The relationship $$L43 \leqq V(F43 \times \in 43^{1/2} \times 100)$$

is satisfied where a transmission path length between the 1:1024 phase demultiplexer 405 and the 8-bit D/A converter 411 is L43, a propagating speed of electromagnetic waves in a vacuum is V, a frequency of a signal transmitted between the 1:1024 phase demultiplexer 405 and the 8-bit D/A converter 411 is F43, and a comparative dielectric constant of a transmission path medium between the 1:1024 phase demultiplexer 405 and the 8-bit D/A converter 411 is ∈43.

Thus, the EMI noise based on the signal transmission between the LVDS interface 401 and the timing controller 402, the signal transmission between the timing controller 402 and the signal line driving portion 404 or the signal transmission between the 1:1024 phase demultiplexer 405 and the 8-bit D/A converter 411 can be suppressed. Therefore, faulty operation due to the EMI noise and so on can be effectively prevented.

What is claimed is:

1. A display panel driver, comprising:

an interface for receiving low voltage differential signals and retrieving video signals, synchronous signals, clock signals and control signals from the low voltage differential signals;

a timing controller for generating a display control signal based on the synchronous signals, clock signals and control signals retrieved by the interface; and a signal line driving portion for generating and outputting driving signals for driving signal lines of a display panel based on the video signals retrieved by the interface and the display control signal generated by the timing controller, wherein the relationship $$L1 \leqq V(F1 \times \in 1^{1/2} \times 100)$$

is satisfied where a transmission path length between the interface and the timing controller is L1, a propagating speed of electromagnetic waves in a vacuum is V, a frequency of a signal transmitted between the interface and the timing controller is F1, and a comparative dielectric constant of a transmission path medium between the interface and the timing controller is ∈1, and the relationship $$L2 \leqq V(F2 \times \in 2^{1/2} \times 100)$$

is satisfied where a transmission path length between the timing controller and the signal driving portion is L2, a propagating speed of electromagnetic waves in a vacuum is V, a frequency of a signal transmitted between the timing controller and the signal line driving portion is F2, and a comparative dielectric constant of a transmission path medium between the timing controller and the signal line driving portion is ∈2.

2. The display panel driver according to claim 1, further comprising a display control signal output portion for outputting the display control signals generated by the timing controller to a scan line driving circuit for driving scan lines of the display panel.

3. The display panel driver according to claim 2, wherein the display control signals output from the control signal output portion are low voltage differential signals.

4. The display panel driver according to claim 2, wherein the display control signals output from the control signal output portion are TTL/CMOS signals.

5. The display panel driver according to claim 1, wherein the interface, the timing controller and the signal line driving portion are provided on a substrate of the display panel.

6. The display panel driver according to claim 2, wherein the interface, the timing controller and the signal line driving portion are provided on a substrate of the display panel.

7. The display panel driver according to claim 3, wherein the interface, the timing controller and the signal line driving portion are provided on a substrate of the display panel.

8. The display panel driver according to claim 4, wherein the interface, the timing controller and the signal line driving portion are provided on a substrate of the display panel.

9. The display panel driver according to claim 1, further comprising a phase demultiplexer for demultiplexing the video signals retrieved by the interface to lower a frequency thereof by 1/n multiplying, wherein the signal line driving portion generates and outputs the driving signals for driving the signal lines based on video signals demultiplexed by the demultiplexer.

10. The display panel driver according to claim 2, further comprising a phase demultiplexer for demultiplexing the video signals retrieved by the interface to lower a frequency thereof by 1/n multiplying, wherein the signal line driving portion generates and outputs the driving signals for driving the signal lines based on video signals demultiplexed by the demultiplexer.

11. The display panel driver according to claim 3, further comprising a phase demultiplexer for demultiplexing the video signals retrieved by the interface to lower a frequency thereof by 1/n multiplying, wherein the signal line driving portion generates and outputs the driving signals for driving the signal lines based on video signals demultiplexed by the demultiplexer.

12. The display panel driver according to claim 4, further comprising a phase demultiplexer for demultiplexing the video signals retrieved by the interface to lower a frequency thereof by 1/n multiplying, wherein the signal line driving portion generates and outputs the driving signals for driving the signal lines based on video signals demultiplexed by the demultiplexer.

13. The display panel driver according to claim 9, wherein the relationship $$L3 \leqq V(F3 \times \in 3^{1/2} \times 100)$$

is satisfied where a transmission path length between the phase demultiplexer and the signal line driving portion is L3, a propagating speed of electromagnetic waves in a vacuum is V, a frequency of a signal transmitted between the phase demultiplexer and the signal line driving portion is F3, and a comparative dielectric constant of a transmission path medium between the phase demultiplexer and the signal line driving portion is ∈3.

14. The display panel driver according to claim 10, wherein the relationship $$L3 \leqq V(F3 \times \in 3^{1/2} \times 100)$$

is satisfied where a transmission path length between the phase demultiplexer and the signal line driving portion is L3, a propagating speed of electromagnetic waves in a vacuum is V, a frequency of a signal transmitted between the phase demultiplexer and the signal line driving portion is F3, and a comparative dielectric constant of a transmission path medium between the phase demultiplexer and the signal line driving portion is ∈3.

15. The display panel driver according to claim 11, wherein the relationship $$L3 \leqq V(F3 \times \in 3^{1/2} \times 100)$$

is satisfied where a transmission path length between the phase demultiplexer and the signal line driving portion is L3, a propagating speed of electromagnetic waves in a vacuum is V, a frequency of a signal transmitted between the phase demultiplexer and the signal line driving portion is F3, and a comparative dielectric constant of a transmission path medium between the phase demultiplexer and the signal line driving portion is ∈3.

16. The display panel driver according to claim 12, wherein the relationship $$L3 \leqq V(F3 \times \in 3^{1/2} \times 100)$$

is satisfied where a transmission path length between the phase demultiplexer and the signal line driving portion is L3, a propagating speed of electromagnetic waves in a vacuum is V, a frequency of a signal transmitted between the phase demultiplexer and the signal line driving portion is F3, and a comparative dielectric constant of a transmission path medium between the phase demultiplexer and the signal line driving portion is ∈3.

17. The display panel driver according to claim 9, wherein the phase demultiplexer is provided on a substrate of the display panel.

18. The display panel driver according to claim 10, wherein the phase demultiplexer is provided on a substrate of the display panel.

19. The display panel driver according to claim 11, wherein the phase demultiplexer is provided on a substrate of the display panel.

20. The display panel driver according to claim 12, wherein the phase demultiplexer is provided on a substrate of the display panel.

21. The display panel driver according to claim 13, wherein the phase demultiplexer is provided on a substrate of the display panel.

22. The display panel driver according to claim 14, wherein the phase demultiplexer is provided on a substrate of the display panel.

23. The display panel driver according to claim 15, wherein the phase demultiplexer is provided on a substrate of the display panel.

24. The display panel driver according to claim 16, wherein the phase demultiplexer is provided on a substrate of the display panel.

25. The display panel driver according to claim 1, wherein the display panel driver is an integrated circuit.

26. The display panel driver according to claim 25, wherein the integrated circuit is provided on a substrate of the display panel driver.

27. The display panel driver according to claim 26, wherein the integrated circuit is provided along one side of the display panel, and the length of the display panel driver in a direction along the side of the display panel is equal to the length of the side.

28. The display panel driver according to claim 26, wherein a material of the substrate of the integrated circuit is the same as a material used for the substrate of the display panel.

29. The display panel driver according to claim 27, wherein a material of the substrate of the integrated circuit is the same as a material used for the substrate of the display panel.

* * * * *